US008505594B2

(12) United States Patent
Krulitsch

(10) Patent No.: US 8,505,594 B2
(45) Date of Patent: Aug. 13, 2013

(54) BEVERAGE BOTTLING PLANT HAVING A FILLING MACHINE WITH MULTIPLE BEVERAGE FILLING ELEMENTS, A FILLING MACHINE WITH MULTIPLE BEVERAGE FILLING ELEMENTS, A FILLING ELEMENT AND RELATED METHOD

(71) Applicant: Dieter-Rudolf Krulitsch, Bad Kreuznach (DE)

(72) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/663,088

(22) Filed: Oct. 29, 2012

(65) Prior Publication Data

US 2013/0105043 A1 May 2, 2013

Related U.S. Application Data

(63) Continuation of application No. 12/250,855, filed on Oct. 14, 2008, now abandoned.

(51) Int. Cl.
*B65B 3/04* (2006.01)

(52) U.S. Cl.
USPC ..... 141/104; 141/90; 141/146; 141/148; 141/302; 141/392

(58) Field of Classification Search
USPC ..... 141/5–6, 89–91, 104, 144–148, 301–302, 141/392
See application file for complete search history.

(56) References Cited

U.S. PATENT DOCUMENTS

| | | | |
|---|---|---|---|
| 4,410,108 | A | 10/1983 | Minard |
| 5,193,593 | A | 3/1993 | Denis et al. |
| 5,313,990 | A | 5/1994 | Clusserath |
| 5,372,283 | A | 12/1994 | Schmitkons et al. |
| 5,431,198 | A | 7/1995 | Turtchan et al. |
| 6,189,578 | B1 | 2/2001 | Clusserath |
| 6,213,169 | B1 | 4/2001 | Clusserath |
| 6,375,050 | B1 | 4/2002 | Gruson |
| 7,308,917 | B2 | 12/2007 | Krulitsch |
| 7,353,848 | B2 | 4/2008 | Krulitsch |

(Continued)

FOREIGN PATENT DOCUMENTS

| | | |
|---|---|---|
| DE | 39 03 768 | 3/1990 |

(Continued)

OTHER PUBLICATIONS

International Search Report PCT/EP2007/002998 and English translation thereof, Aug. 14, 2007.
International Preliminary Report on Patentability PCT/EP2007/002998 English translation, Nov. 17, 2008.

*Primary Examiner* — Gregory Huson
*Assistant Examiner* — Nicolas A Arnett
(74) *Attorney, Agent, or Firm* — Nils H. Ljungman & Associates

(57) ABSTRACT

A container filling element for filling containers with a liquid. The filling element has two liquid ducts and two separate discharge openings in a housing, as well as separate valves which control the flow of liquid for each liquid duct and discharge opening. A gas shutoff element is disposed in one of the liquid ducts and is positioned adjacent to each of the discharge openings.

20 Claims, 8 Drawing Sheets

(56) References Cited

U.S. PATENT DOCUMENTS

| | | | | |
|---|---|---|---|---|
| 7,469,726 | B2 | 12/2008 | Clusserath et al. | |
| 2004/0149784 | A1 | 8/2004 | Solignac | |
| 2005/0241726 | A1 * | 11/2005 | Clusserath et al. | 141/144 |
| 2005/0257499 | A1 | 11/2005 | Krulitsch | |

FOREIGN PATENT DOCUMENTS

| | | |
|---|---|---|
| DE | 10 2004 015 167 | 11/2005 |
| EP | 0 567 913 | 11/1993 |
| EP | 1 593 648 | 11/2005 |
| JP | 2001-122394 | 5/2001 |

* cited by examiner

BEVERAGE BOTTLING PLANT HAVING A FILLING MACHINE WITH MULTIPLE BEVERAGE FILLING ELEMENTS, A FILLING MACHINE WITH MULTIPLE BEVERAGE FILLING ELEMENTS, A FILLING ELEMENT AND RELATED METHOD

CONTINUING APPLICATION DATA

This application is a continuation application of co-pending U.S. application Ser. No. 12/250,855, filed Oct. 14, 2008. U.S. application Ser. No. 12/250,855 is a Continuation-In-Part application of International Patent Application No. PCT/EP2007/002998, filed on Apr. 3, 2007, which claimed priority from Federal Republic of Germany Patent Application No. 10 2006 017 706.1, filed on Apr. 15, 2006. The United States was an elected state in International Patent Application No. PCT/EP2007/002998.

BACKGROUND

1. Technical Field

This present application relates to a beverage bottling plant, a filling element, a filling machine and related methods.

2. Background Information

Background information is for informational purposes only and does not necessarily admit that subsequently mentioned information and publications are prior art.

There are various models of filling elements for use in filling machines, possibly in filling machines that are based on a rotary construction, for the filling of bottles or similar containers with a bulk liquid. For example, there are described filling elements for open-jet filling, a process in which, during the filling phase, the liquid to be bottled flows in the form of an open jet from the discharge opening of the filling element to the individual container, which is at some distance from the filling element. There are also described filling elements for the pressure filling or counter pressure filling, in which, during the filling phase, the liquid to be bottled flows under pressure (filling pressure) into the individual container, which is in sealed contact with the filling element.

One basic problem with open-jet filling is residual dripping from the filling element after the end of the filling phase and after the removal of the filled container from the container carrier. This dripping can be hindered or restricted by the use of a gas shutoff valve on the discharge opening.

However, a filling element with a gas shutoff valve located on its discharge opening cannot be used for pressure filling, possibly for the bottling of a carbonated liquid.

During or after the closing of the filling valve, a certain quantity of the liquid being bottled is retained above the gas shutoff valve in the direction of flow in line with the shutoff valve. During the discharge of the pressure and/or residue, the carbon dioxide contained in the carbonated liquid that is immediately above or relatively immediately above the gas shutoff valve is depressurized. Consequently, the liquid is pushed through the gas shutoff valve, which possibly results in a significant contamination of the filling machine, which may be unacceptable, usually during cold aseptic bottling, on account of the high requirements for sterility.

If such filling elements are used both for open-jet filling and for pressure filling, to restrict or hinder dripping it is therefore desired, before the machine can be used for pressure filling, to remove the gas shutoff valves that are provided during the open-jet filling, and conversely to re-install the gas shutoff valves after pressure filling and before open-jet filling, which could potentially require a time-consuming and labor-intensive changeover of the respective filling machine and entails additional production costs as well as additional cleaning cycles.

OBJECT OR OBJECTS

An object of the present application is to describe a filling element which makes possible an easy and problem-free changeover between open-jet filling and pressure filling. The present application teaches that this object is accomplished by the filling element being for a filling machine for filling bottles or similar containers (2, 2*a*) with a liquid to be bottled. That filling element has a liquid duct (8) realized in a housing (6) of the filling element (1), with a controllable first liquid valve (23) located in the liquid duct (8) between a connection (9) for the delivery of the liquid to be bottled and at least a first discharge opening (22) for the discharge of the liquid into the containers (2, 2*a*) to be filled. In the housing (6) of that filling element (1, 1*a*), in addition to liquid duct (8), an additional flow duct (7) is realized which can controlled by means of an additional liquid valve (15) placed in communication with the connection (9) for the delivery of the liquid being bottle. That additional flow duct (7), in the vicinity of the first discharge opening (22), forms at least one additional discharge opening in which a gas shutoff valve (13.1) is provided.

A filling machine comprises a reservoir arrangement configured and disposed to contain at least one of: a supply of effervescent liquid beverage materials; and a supply of non-effervescent liquid beverage materials. Each beverage filling element for that filling machine is configured and disposed to control dispensing of effervescent and non-effervescent liquid beverage materials from that reservoir arrangement into bottles. Each such filling element comprises a non-effervescent liquid beverage discharge opening; and a non-effervescent liquid beverage duct configured and disposed to permit flow of the non-effervescent liquid beverage from said reservoir arrangement and through said non-effervescent liquid beverage discharge opening. The non-effervescent liquid beverage discharge opening is configured to open-fill a bottle positioned beneath and disposed away from said non-effervescent liquid beverage discharge opening.

The aforementioned non-effervescent liquid beverage duct comprises a non-effervescent liquid beverage valving arrangement configured and disposed to move for opening and closing access of said non-effervescent liquid beverage to said non-effervescent liquid beverage discharge opening; and a gas shutoff element at or near said non-effervescent liquid beverage discharge opening, said gas shutoff element being configured to minimize leakage of non-effervescent liquid beverage from said non-effervescent liquid beverage discharge opening.

Each beverage filling element further comprises an effervescent liquid beverage discharge opening; and an effervescent liquid beverage duct configured and disposed to permit flow of the effervescent liquid beverage from said reservoir arrangement and through said effervescent liquid beverage discharge opening.

That effervescent liquid beverage discharge opening is configured to pressure-fill a bottle positioned beneath and sealingly against said effervescent liquid beverage discharge opening.

The aforementioned effervescent liquid beverage duct comprises an effervescent liquid beverage valving arrangement configured and disposed to move for opening and closing access of said effervescent liquid beverage to said effervescent liquid beverage discharge opening.

SUMMARY

The filling element according to one possible embodiment of the present application can be used optionally for open jet filling and for pressure filling without the desire for the removal or reinstallation of the gas shutoff valves. In both cases the filling element is drip-free. During pressure filling, the liquid to be bottled is guided in the interior of the filling element along a flow path or liquid duct in which there is no gas shutoff valve. The gas shutoff valve is located in an additional flow path which is used as a return gas duct during pressure filling. The return gas is thereby routed through the gas shutoff valve, which can be done without any disadvantages. The conversion from pressure filling to open-jet filling may or may not require the closing of the fluid valve that is used for the pressure filling and the opening of an additional fluid valve, via which the liquid being bottled travels into the additional flow path which has the discharge opening that is provided with the gas shutoff valve, so that it can flow in the form of an open jet to the container to be filled via this flow path and the discharge opening provided with the gas shutoff valve. The words "gas shutoff valve" herein generally do not necessarily mean a moveable valving structure but usually means a static gas shutoff element or liquid containment element such as a sieve-like structure or a series of parallel plates.

The changeover between the two filling methods (open-jet filling/pressure filling) can thus be carried out simply by controlling the corresponding valves without having to install additional components on the filling element. The gas shutoff valve may not need to be removed or re-installed for the changeover.

The filling element according to one possible embodiment of the present application is suitable for the open-jet filling and the pressure filling of bottles or other containers, and possibly also for the open-jet filling and pressure filling of cans. Developments of the present application are described in the dependent claims.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in greater detail below on the basis of an embodiment which is illustrated in the accompanying drawings, in which.

DESCRIPTION OF EMBODIMENT OR EMBODIMENTS

As used herein, the term "open-fill" includes filling beverage containers, i.e. bottles, cans and the like, with a liquid beverage that does not have to be stored under pressure for filling. Hence, the connection between filling element of a typical filling machine and the container into which liquid beverage will be deposited can be kept open to the air and surrounding environs. It does not have to be maintained under set pressure conditions. By contrast, the term "pressurized" or "pressure-fill" means a beverage bottling filling arrangement for receiving a liquid beverage material stored under pressure by a gas. This arrangement is especially suited for the bottling of effervescent, or "carbonated" beverages, including sodas and the like.

Figure 1:
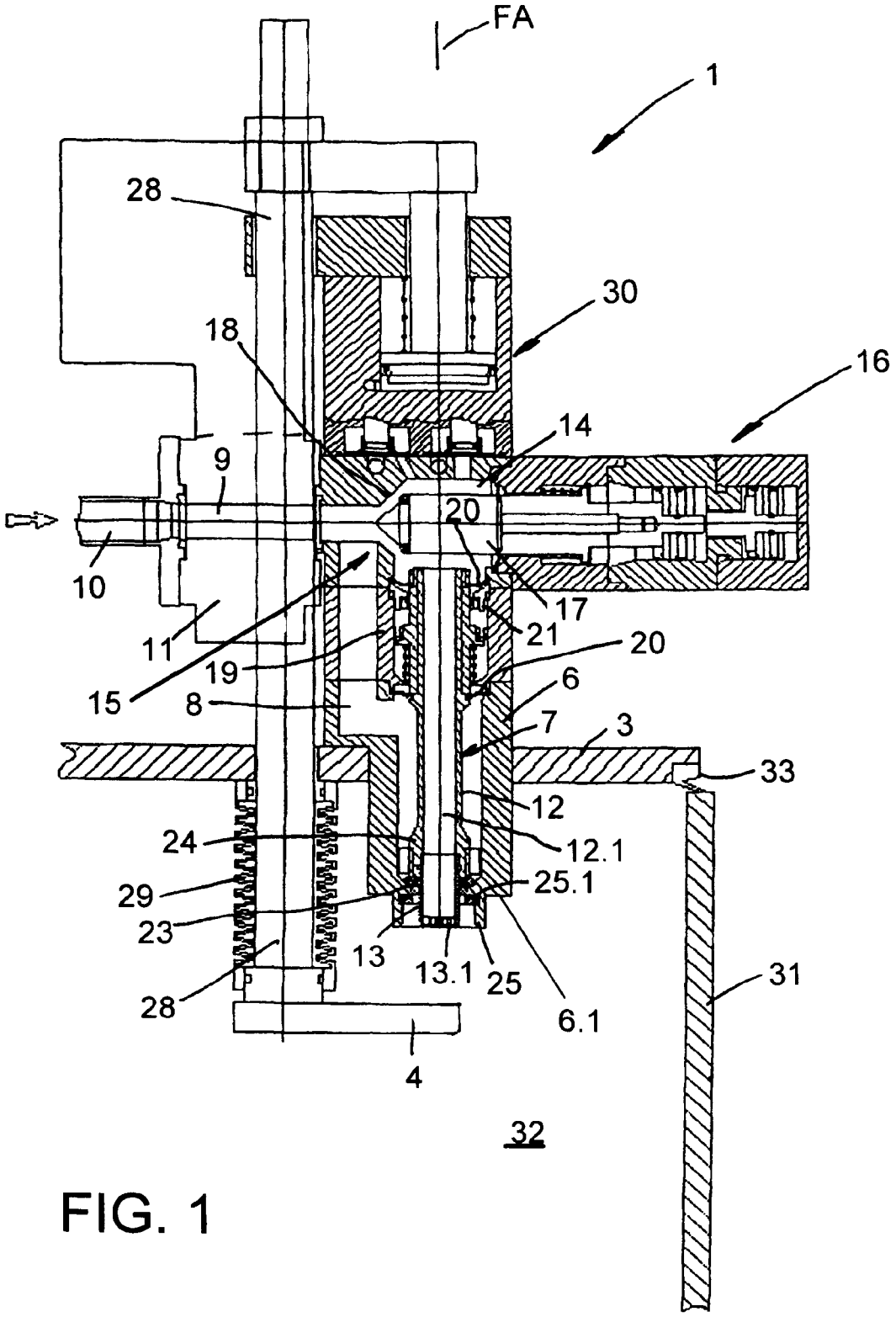
FIG. 1 is a simplified sectional drawing of a filling element of a filling machine that is based on a rotary construction, together with a container holder or bottle holder that is associated with this filling element.
Figure 1A:
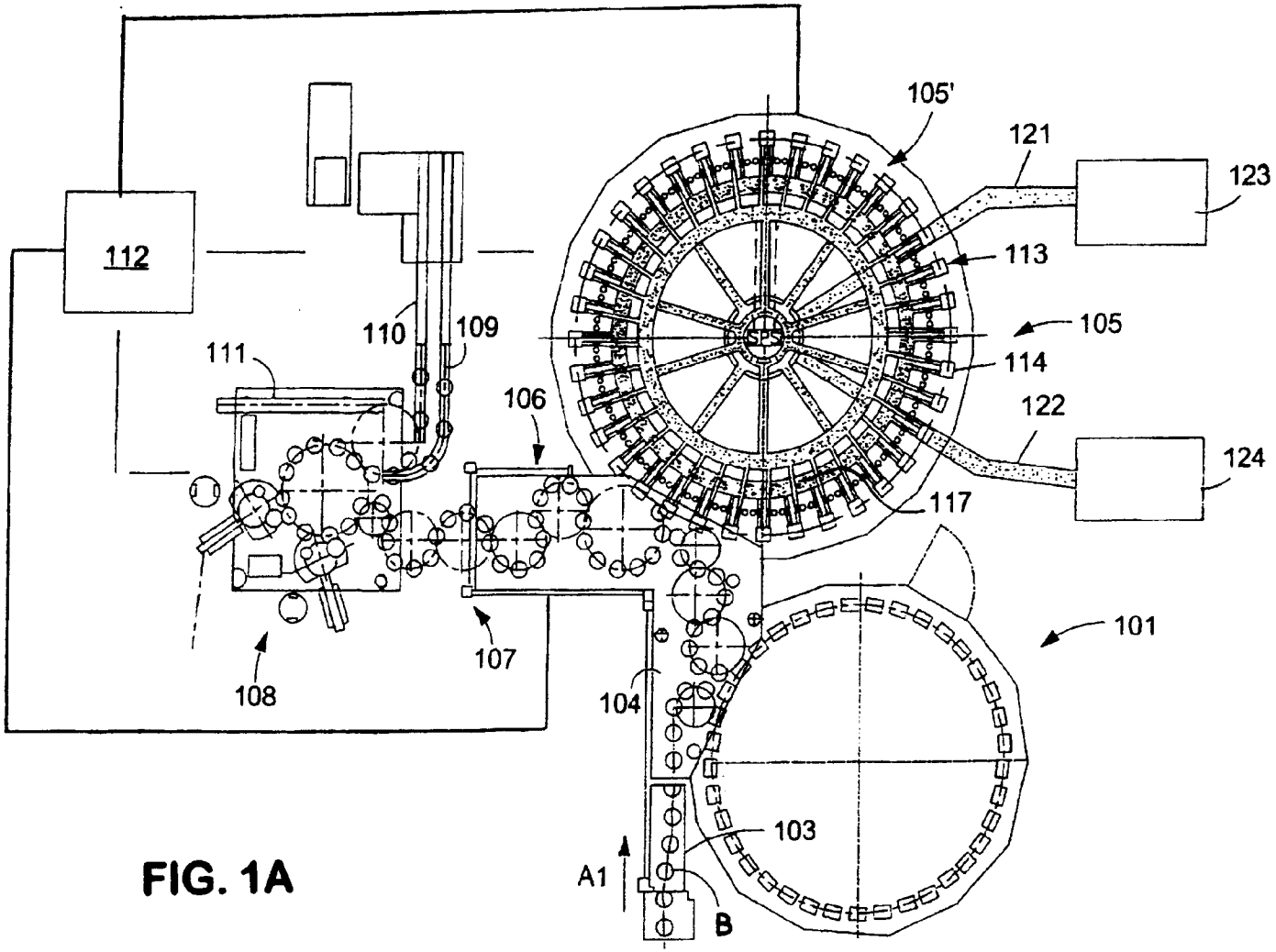
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device. In the illustrated embodiment, the beverage bottle labeling arrangement or labeling station 108 has at least one labeling unit, device, or module, for applying labels to bottles B. In the embodiment shown, the labeling arrangement 108 has three output conveyer arrangements: a first output conveyer arrangement 109, a second output conveyer arrangement 110, and a third output conveyer arrangement 111, all of which convey filled, closed, and labeled bottles B to different locations. In the event pre-labeled bottles are used, a beverage labeling station 108 would not necessarily be needed and could be omitted from the process of the beverage bottling plant.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In the figures, 1 is a filling element of a filling machine that is based on the rotary construction for the filling of bottles 2 with a bulk liquid. The filling element 1, together with a plurality of additional filling elements, is provided on the periphery of a rotor 3 which can be driven in rotation around the vertical machine axis and which, together with a bottle holder 4, forms one of the filling positions on the rotor 3.

The filling element 1 can be used for, among other things, filling using the open-jet method, in which the individual bottle 2 is located with its bottle mouth 2.1 at some distance from the filling element 1 and the liquid to be bottled flows into the respective bottle during the filling process in the form of an open stream 5 so that the air and/or gas volume in the bottle neck 2.1 displaced from the bottle by the liquid can travel without restriction into the environment.

Figure 3:
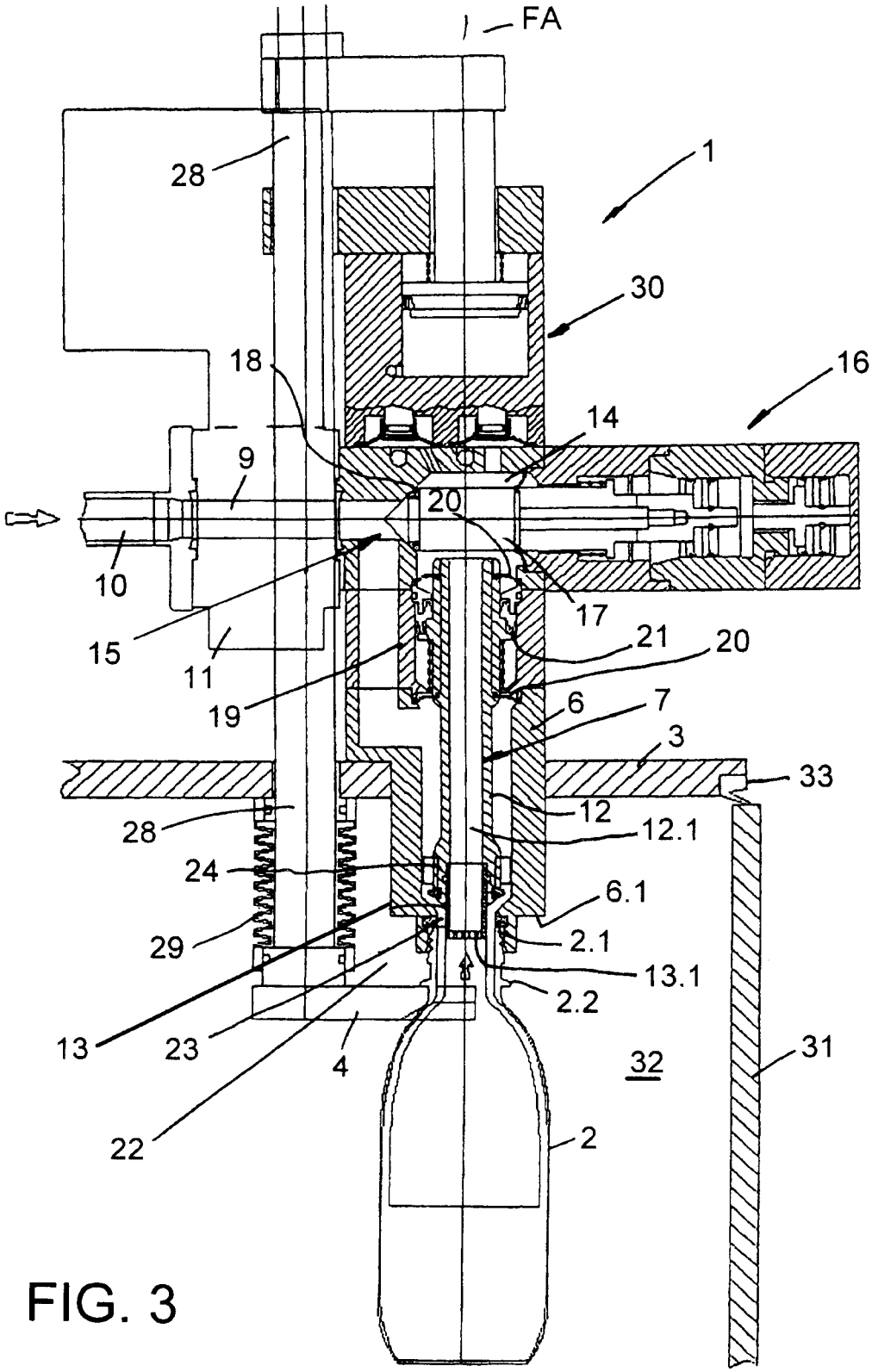
FIG. 3 shows the filling element from FIG. 1 together with a bottle to be filled in a pressure or counter pressure filling process.

The filling element 1 is also suitable for the filling of the bottles 2 under counter pressure (pressure filling), whereby during the filling process and as illustrated in FIG. 3, the bottle is placed in tight contact with their its mouth 2.1 against the respective filling element 1.

The individual filling element 1 comprises a housing 6 in which there is, among other things, a branched flow route which is formed by the two flow paths 7 and 8. Associated with these flow paths is a common connecting duct 9, by means of which the liquid being bottled is delivered during the filling process from an external connection 10. The connecting duct 9 simultaneously or substantially simultaneously forms the measuring path of a measurement instrument 11 (MID sensor), with which the quantity of liquid the flows into the individual bottle 2 during the filling is measured to control the volume of the filling process.

The flow path 7 is formed partly by the plunger duct 12.1, which is open on both ends, of a tubular plunger 12 which with its axis defines the filling element axis FA, which plunger transitions on the housing bottom 6.1 into a tube segment 13 in which a gas shutoff valve 13.1 is located and which forms a short filling tube for the open-jet filling. In the simplest case, the gas shutoff valve 13.1 is a screen-like insert with a plurality of openings and/or an insert which has a number of ducts, each of which is open to the plunger duct 12.1 as well as to the lower end of the tube segment 13 which forms the discharge opening for the liquid being bottled. At its upper end, the plunger duct 12.1 emerges into a valve chamber 14 of a liquid valve 15, by means of which the valve chamber 14 and thus also the plunger duct 12.1 can be placed in communication in a controlled manner with the branching point of the two flow paths 7 and 8 and/or with the connecting duct 9. The liquid valve 15 comprises a valve body 17 which is actuated by a actuator device 16, which in the illustrated embodiment is can be moved to open and close the liquid valve 15 by a reciprocating movement in an axial direction which is oriented perpendicularly or virtually perpendicularly with respect to the filling element axis FA and thus radially with respect to the machine axis, and interacts with a corresponding valve face 18.

The plunger 12 can move axially by a specified stroke length in the direction of the filling element axis FA in the housing 6 or in a cylindrical housing segment 19 which is realized in this housing, and possibly using disc-shaped membrane seals 20 and radial seals 21 which, in the vicinity of the housing segment 19, seal the gap between the outside surface of the plunger 12 and the cylindrical interior surface of the housing segment 19 that surrounds this plunger. The plunger 12 is biased by a spring force toward the lower position of its stroke movement.

The flow path 8 is realized in a manner similar to the liquid duct in conventional filling elements, and on the underside 6.1 of the housing 6 emerges into a ring-shaped discharge opening 22 which surrounds the tube segment 13, on which discharge opening 22 there is a second liquid valve 23 which is closed when the plunger 12 is lowered. For the liquid valve 23, the lower end of the plunger 12 is realized in the form of a valve body 24, which interacts with a valve surface which is realized in the flow path 8 in the vicinity of the discharge opening 22.

On the housing underside 6.1 there is also a ring-shaped centering element 25 which projects some distance beyond this underside, and in which there is also a ring-shaped gasket 25.1 which surrounds the discharge opening 22, against which gasket the respective bottle 2 is pressed in sealed contact by means of its mouth 2.1 during the pressure filling.

In the illustrated possible embodiment, two controlled gas ducts 26 and 27 emerge into the valve chamber 14, in each of which gas ducts there is a controllable valve 26.1 and 27.1 respectively.

Figure 2:
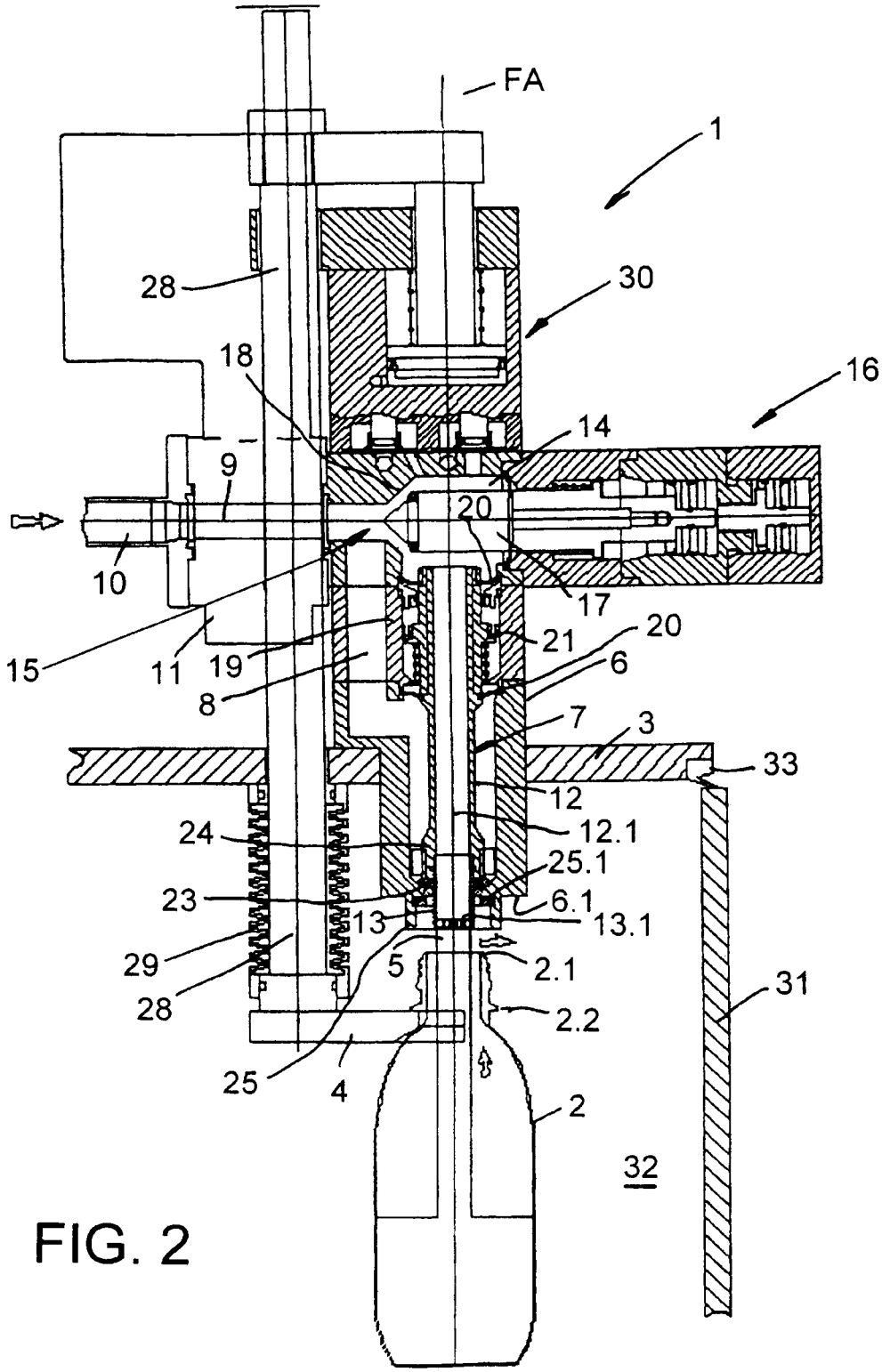
FIG. 2 shows the filling element illustrated in FIG. 1, together with a bottle to be filled in an open-jet filling process.

In the possible embodiment illustrated in FIGS. 1 through 3, the container carrier 4 is realized so that the respective bottle 2 is held suspended on the container carrier by a neck flange 2.2. To raise and lower the container carrier 4, the container carrier is held on a rod 28 which is oriented with its axis parallel or virtually parallel to the filling element axis FA and guided so that it can be displaced axially by a reciprocating movement on the housing 6 and on the rotor 3. The rod 28 and thus also the respective container carrier 4 are biased toward the bottom, lowered stroke position by a compression spring 29. By means of an actuator device 30 in the form of a pneumatic piston-cylinder arrangement, for example, which interacts with the upper end of the rod 28, the rod 28 and the container carrier 4 can be raised from the bottom stroke position. The bottom stroke position of the rod 28 and thus the lower position of the container carrier 4 corresponds to the position during open-jet filling. For pressure filling, the rod 28 and the respective container carrier 4 are moved into a top stroke position.

As the figures also show, the tube segment 13 which has the gas shutoff valve 13.1 projects downward beyond the plane of the ring-shaped gasket 25.1 and thus also beyond the discharge opening 22, whereby the lower end of the gas shutoff valve 13 lies on approximately the same level as the lower edge of the centering element 25.

31 indicates a wall which separates an interior space 32, in which the guide elements 1 with their lower end and the container carriers 4 circulate, from the atmosphere, e.g. for cold-aseptic bottling. A seal 33 is provided at the transition between the rotor 3 and the stationary wall 31.

For open-jet bottling, as illustrated in FIG. 2, at a container inlet of the filling machine, the bottles are transferred individually to a filling position which is formed by a filling element 1 and an associated container carrier 4, and possibly such that each bottle 2 is held oriented with its bottle axis co-axially or approximately co-axially with the filling element axis FA, with the neck flange 2.2 suspended on the container carrier 4, and possibly with the bottle mouth 2.1 at some distance from the filling element 1 or from the lower end of the tube segment 13 that has the gas shutoff valve 13.1. Opening the liquid valve 15 initiates the filling process, i.e. the liquid travels through the outer connection 10, the connection duct 9, the valve chamber 14, the plunger duct 12.1 and the tube segment 13 that has the gas shutoff valve 13.1 in the form of an open jet 5 into the interior of the respective bottle 2. The individual duct 8 and the ring-shaped discharge opening 22 are closed by the liquid valve 23.

The quantity of liquid that flows into the respective bottle 2 during the filling process is measured by means of the measurement device 11. When the desired filling volume is reached, in response to the signal sent by the measurement device 11, the liquid valve 15 is closed and the filling process is thereby ended. The filled bottles 2 are removed from the respective container holders 4 at a container outlet and conducted to a machine in which they are closed or capped (closer or capper). As a result of the use of the gas shutoff valves 13.1 on the filling elements, any dripping of the liquid being bottled after the removal of the respective bottle 2 is effectively restricted or hindered.

To empty the valve chamber 14 and the plunger duct 12.1, one of the two gas ducts 26 or 27 can be opened to the atmosphere or to a special gas duct, which can be realized in the rotor, for example, by actuating the corresponding control or gas valve 26.1 or 27.1.

FIG. 3 shows the mode of operation of the respective filling element 1 during pressure filling. The respective bottle 2 is thereby raised with the container carrier 4 so that its bottle mouth 2.1 is in sealed contact against the filling element 1 or the gasket 25.1 In this operating mode the liquid valve 15 is closed. By opening one of the control valves 26.1 and 27.1, the interior 2 of the bottle 2 which is in sealed contact with the filling element 1 is pressurized by means of the valve chamber 14 and the plunger duct 12.1, for example, i.e. the interior of the container is pressurized with an inert gas under pressure. The liquid to be bottled travels via the outer connection 10 and the connecting duct 9 at the filling pressure in the flow direction 8, so that on the basis of this pressure, which is exerted on, among other things, the bottom, ring-shaped membrane seal 20, the plunger 12 is moved into its upper stroke position and the liquid valve 23 opens, so that the liquid being bottled then flows into the respective bottle 2 through the ring-shaped discharge opening 22 along the inside surface of the bottle. The return gas which is displaced out of the bottle 2 by the liquid being bottled flows through the gas shutoff valve 13.1, through the plunger duct 12.1, which in this mode of operation acts as a return gas duct, and through the valve chamber 14 into at least one opened gas duct 26 or 27. In response to the signal from the measurement device 11, when the desired fill volume is reached, the filling process is ended by closing the gas ducts 26 and 27 and the liquid valve 23.

Figure 3A:
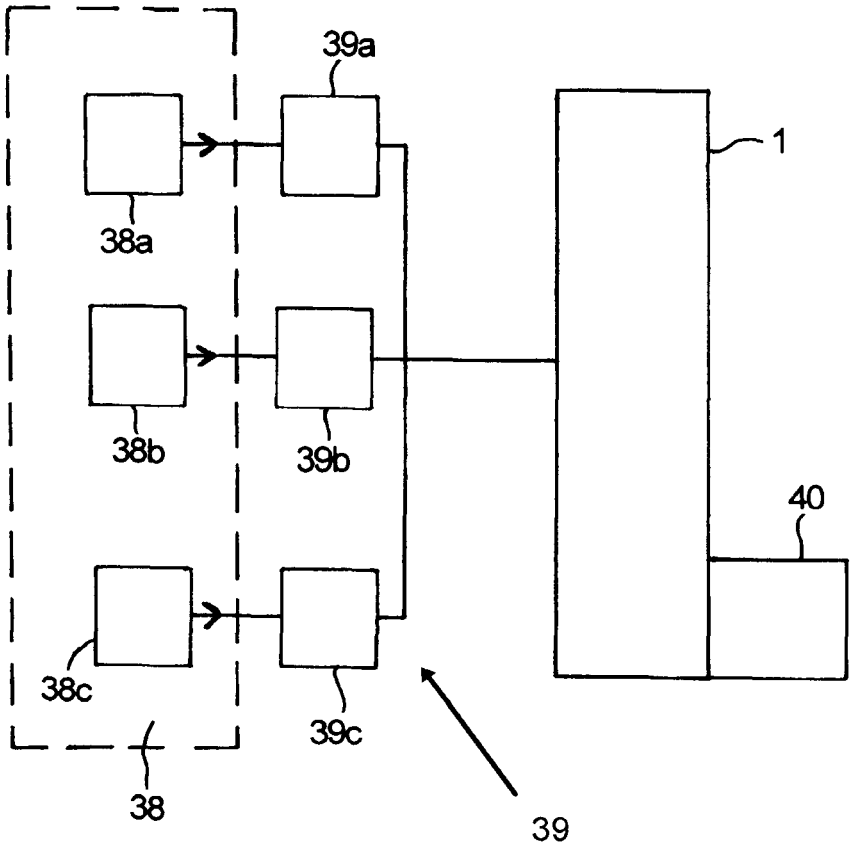
FIG. 3A shows a filling element together with some representative reservoir arrangements, related valving and a magnetic flow meter for said filling element.

In FIG. 3A, there is shown one embodiment of reservoir arrangement schematically represented by boxed element 38. A valving arrangement 39 connects reservoir 38 to the rest of this bottling system. It is to be understood that within reservoir 38 there could be a plurality of sub-divided units, such as a first effervescent liquid beverage reservoir 38*a*, a second, non-effervescent liquid beverage reservoir 38*b*, and a third, stand alone reservoir 38*c* reserved for holding a liquid cleaning medium. In that version, each dedicated reservoir would have its own valving system connection, 39 *a, b* and *c*, respectively. Alternately, one or both liquid beverage containing reservoirs may be combined and then adequately flushed with a cleaning medium before filling with the next liquid beverage to be bottled herewith. For that matter, if space constraints dictate, even the stand alone liquid medium reservoir may be eliminated by merely flushing the system with a cleaning medium added to either reservoirs 38*a* or *b*.

Also in FIG. 3A, there is shown a representative magnetic flow meter 40. That flow meter should have a monitoring portion located below and downstream of the filling element valve body and valve seat, and be configured and disposed to monitor flow of liquid beverage material in the liquid duct for same. Some examples of inductive flow meters, such as magnetic inductive flow meters, which may possibly be adapted for use in at least one possible embodiment, may possibly be found in the following U.S. Pat. No. 5,808,208 entitled "Inductive flow meter;" U.S. Pat. No. 5,641,914 entitled "Inductive flow meter;" U.S. Pat. No. 5,121,640 entitled "Electromagnetic flow meter;" U.S. Pat. No. 4,972,722 entitled "Magnetic inductive flow meter;" and U.S. Pat. No. 4,522,073 entitled "Magnetic-inductive flow meter for high temperatures."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

Figure 4:
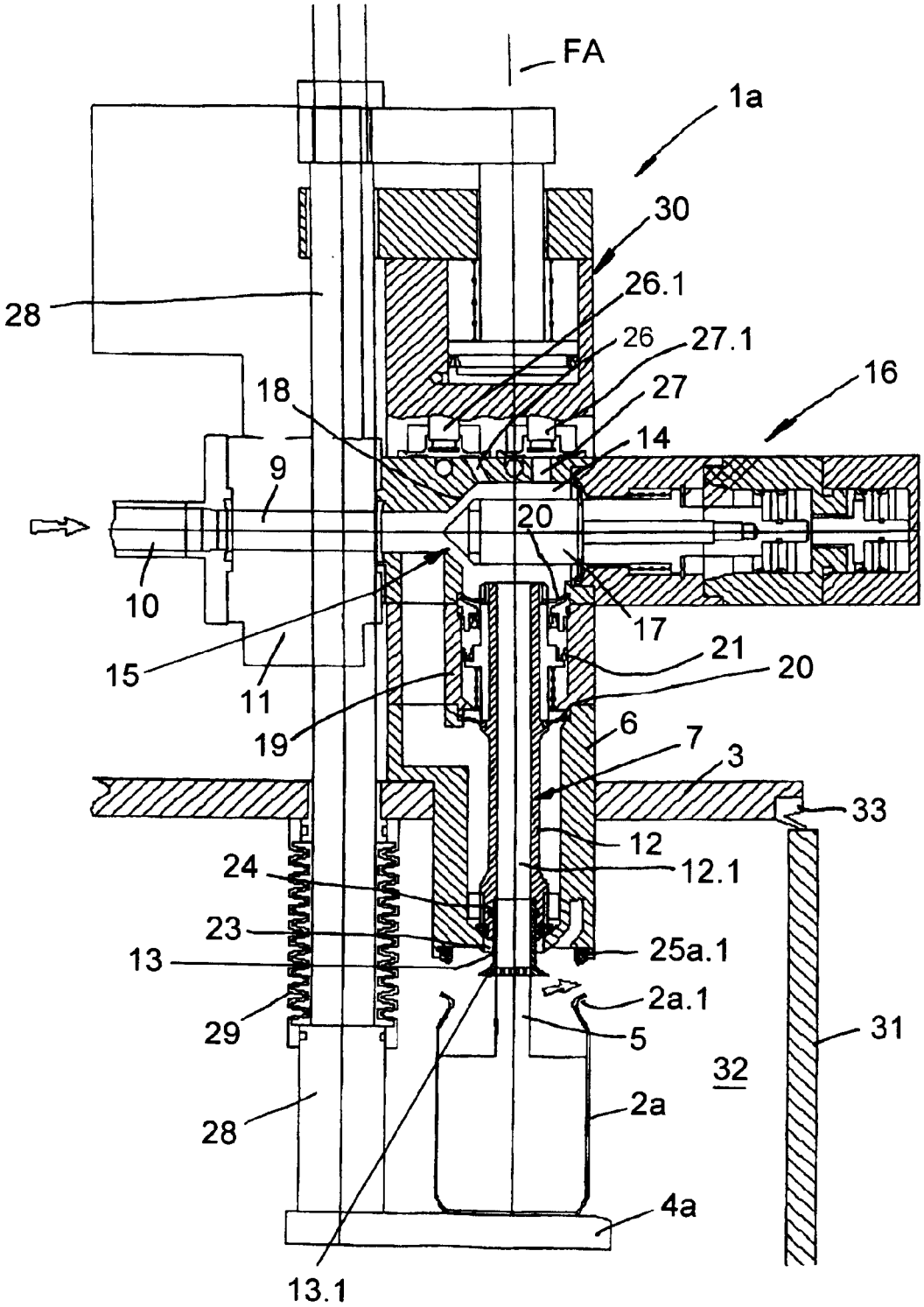
FIG. 4 shows the filling element from FIG. 1, together with a can (e.g. a beverage can) to be filled in an open-jet filling process.

FIG. 4 shows a filling element 1*a* for the optional open-jet filling or pressure filling of cans 2*a*. The filling element 1*a* differs from the filling element 1 essentially in that the gasket 25*a*.1 is slightly larger than the gasket 25.1. FIG. 4 shows the operational status of the filling element 1*a* during the open-jet filling with an open liquid valve 15. The pressure filling is done with the container carrier 4*a* raised toward the gasket 25*a*.1 and the edge of the container or can 2*a*.1 in sealed contact against the gasket 25*a*.1

Figure 5:
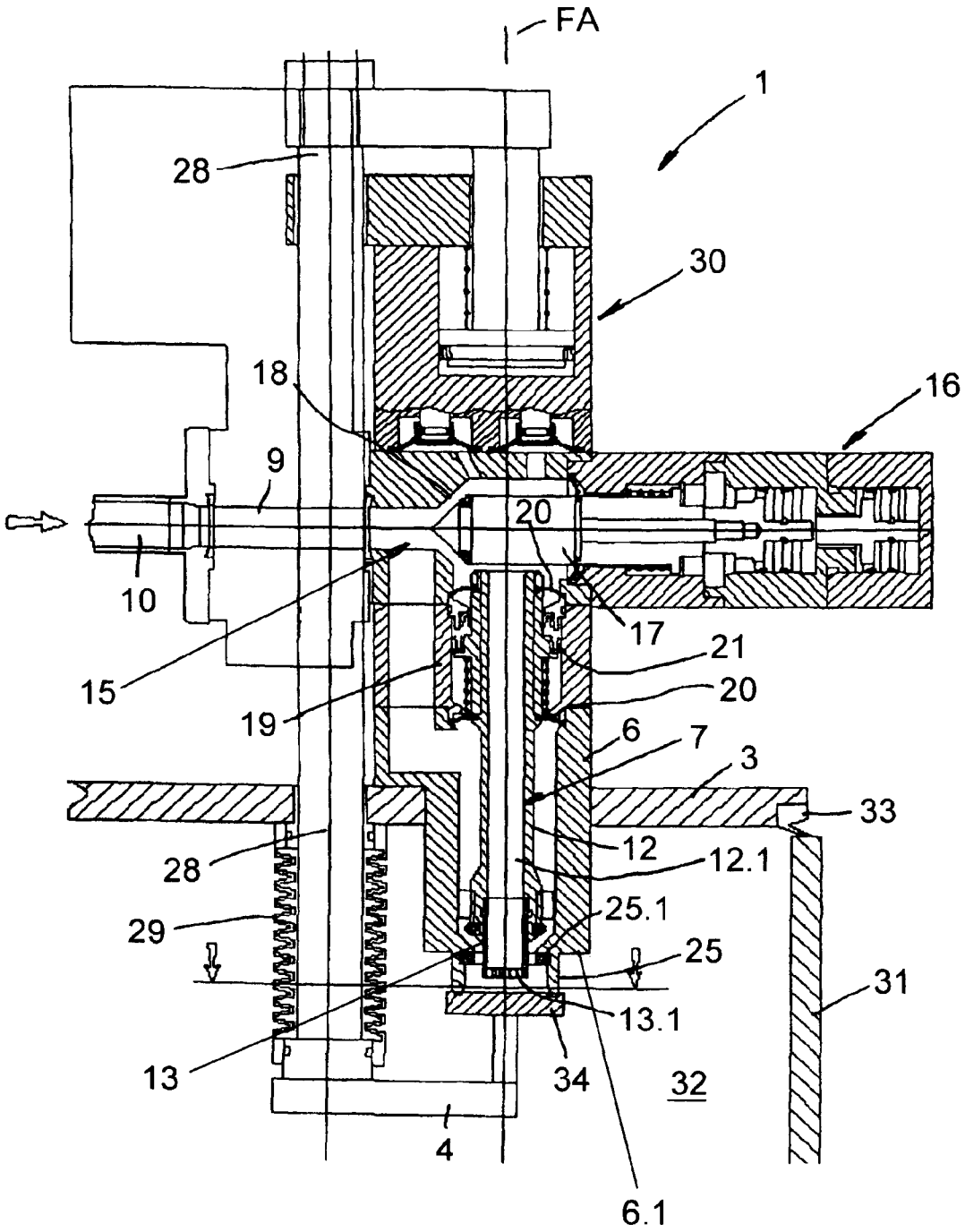
FIG. 5 shows the filling element from FIG. 1 during a CIP (Cleaning In Place) cleaning.
Figure 6:
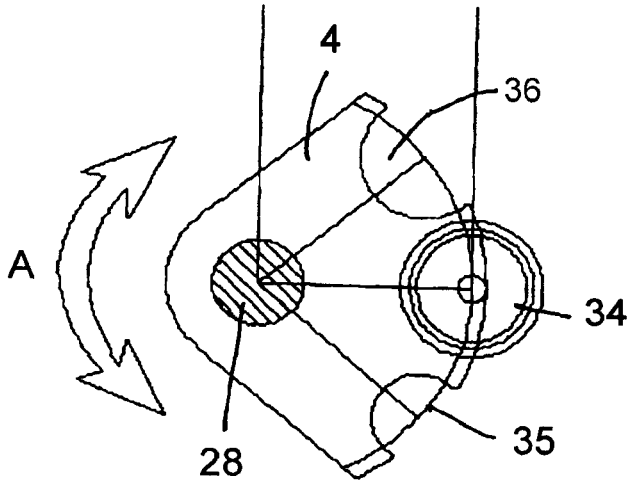
FIG. 6 is a simplified plan view of the container holder or bottle holder of the filling element illustrated in FIG. 1.

FIG. 5 shows the filling element 1 during CIP cleaning. For this purpose, the centering element 24 is closed by a plate-shaped closing element 34, so that when the liquid valves 15 and 23 are opened, all or most or some of the ducts in the interior of the respective filling element 1 can carry the flow of the cleaning medium used for the CIP cleaning. As shown in FIG. 6, the plate-like closing element 34 is provided on the container carrier 4, and can be brought by pivoting the container carrier 4, which is realized in the form of a sector of a circle, around the axis of the rod 28 (double arrow A) into a position underneath the centering element 25, so that, as the result of the activation of the actuator element 30, the closing element 34 is then brought into contact against the centering element 25, to thereby form a rinse cap on the underside 6.1 of the housing, which connects the opened discharge opening 22 with the tube segment 13 that has the gas shutoff valve 13.1.

As also shown in FIG. 6, on the container carrier 4 in the shape of a sector of a circle, recesses 35 and 36 are provided one on each side of the closing element 34, and possibly in different sizes, so that the container carrier 4 can be adjusted by pivoting the rod 28 for bottles 2 that have different diameters in the vicinity of the neck flange 2.2.

One embodiment addresses a beverage bottling plant for filling beverage bottles with effervescent and non-effervescent liquid beverage materials. That beverage bottling plant comprises a rotary beverage filling machine configured and disposed to fill beverage bottles with liquid beverage materials. The filling machine for same comprises: a rotor having a central vertical axis about which said rotor is rotated; a plurality of beverage filling elements for filling beverage bottles with liquid beverage materials disposed on the periphery of that rotor; at least one storage unit, or reservoir, configured and disposed to store a supply of liquid beverage materials; at least one supply line configured and disposed to connect said storage unit to said beverage filling machine to supply liquid beverage materials to said beverage filling machine. The beverage bottling plant further comprises: a first conveyer arrangement configured and disposed to move beverage bottles from the beverage bottle cleaning machine into said beverage filling machine, that first conveyer arrangement comprising a star wheel structure, and a beverage bottle closing machine configured and disposed to close the tops of filled beverage bottles.

The beverage bottling plant further comprises a second conveyer arrangement configured and disposed to move filled beverage bottles from said beverage filling machine into the beverage bottle closing machine, said second conveyer arrangement comprising a star wheel structure; and a beverage bottle labeling machine configured and disposed to label filled, closed beverage bottles.

The beverage bottling plant further comprises a third conveyor arrangement configured and disposed to move filled, closed beverage bottles from said beverage bottle closing machine into said beverage bottle labeling machine, said third conveyer arrangement comprising a star wheel structure. With that, a beverage bottle packing station is configured and disposed to package labeled, filled, closed beverage bottles.

Next, a fourth conveyor arrangement is configured and disposed to move labeled, filled, closed beverage bottles from said beverage bottle labeling machine to said beverage bottle packing station. That fourth conveyer arrangement comprises a linear conveyor structure configured and disposed to arrange beverage bottles in groups for packing.

The aforementioned beverage filling machine comprises a reservoir arrangement configured and disposed to contain at least one of: a supply of effervescent liquid beverage materials; and a supply of non-effervescent liquid beverage materials.

Each of those beverage filling elements is configured and disposed to control dispensing of effervescent and non-effervescent liquid beverage materials from that reservoir arrangement into bottles.

Each of those beverage filling elements comprises a non-effervescent liquid beverage discharge opening; and a non-effervescent liquid beverage duct configured and disposed to permit flow of the non-effervescent liquid beverage from said reservoir arrangement and through said non-effervescent liquid beverage discharge opening. The non-effervescent liquid beverage discharge opening is configured to open-fill a bottle positioned beneath and disposed away from said non-effervescent liquid beverage discharge opening.

The aforementioned non-effervescent liquid beverage duct comprises a non-effervescent liquid beverage valving arrangement configured and disposed to move for opening and closing access of said non-effervescent liquid beverage to said non-effervescent liquid beverage discharge opening; and a gas shutoff element at or near said non-effervescent liquid beverage discharge opening, said gas shutoff element being configured to minimize leakage of non-effervescent liquid beverage from said non-effervescent liquid beverage discharge opening.

Each beverage filling element further comprises an effervescent liquid beverage discharge opening; and an effervescent liquid beverage duct configured and disposed to permit flow of the effervescent liquid beverage from said reservoir arrangement and through said effervescent liquid beverage discharge opening.

That effervescent liquid beverage discharge opening is configured to pressure-fill a bottle positioned beneath and sealingly against said effervescent liquid beverage discharge opening.

The aforementioned effervescent liquid beverage duct comprises an effervescent liquid beverage valving arrangement configured and disposed to move for opening and closing access of said effervescent liquid beverage to said effervescent liquid beverage discharge opening.

In another embodiment, the preceding beverage bottling plant further comprises: a diverting element configured and disposed to divert fluid from said effervescent liquid beverage discharge opening to said non-effervescent liquid beverage discharge opening; at least one liquid cleaning discharge opening; and a cleaning valve configured and disposed to permit flow of a liquid cleaning medium: (i) into said effervescent liquid beverage duct; (ii) across said diverting element; (iii) through said gas shutoff element in a direction opposite the normal filling flow of non-effervescent liquid beverage through said gas shutoff element, (iv) through said non-effervescent liquid beverage duct and (v) through said liquid cleaning discharge opening.

In that beverage bottling plant, one embodiment of non-effervescent liquid beverage valving arrangement comprises a non-effervescent liquid beverage valve comprising a valve plunger disposed in said non-effervescent liquid beverage duct; said valve plunger being configured and disposed to move by a reciprocating stroke for opening and closing said non-effervescent discharge opening to control the flow of non-effervescent liquid beverage through said non-effervescent discharge opening.

One embodiment of effervescent liquid beverage valving arrangement comprises: an effervescent liquid beverage valve, which valve further comprises an actuator element and a valve body disposed in said effervescent liquid beverage duct. The preceding valve body is configured and disposed to move by said actuator element for opening and closing said effervescent discharge opening to control the flow of effervescent liquid beverage through said effervescent discharge opening.

In one embodiment, the non-effervescent liquid beverage discharge opening structure comprises a non-effervescent liquid discharge opening; the effervescent liquid beverage discharge opening structure comprises an effervescent liquid discharge opening; and said non-effervescent liquid discharge opening is disposed adjacent to and below said effervescent liquid discharge opening.

For that embodiment, the effervescent liquid beverage discharge opening structure may comprise a full or partial ring disposed about said non-effervescent liquid beverage discharge opening structure. And, the gas shutoff element may comprise a screen or plurality of ducts, each duct being open at both ends.

One embodiment of effervescent liquid valving arrangement comprises an actuator element; and a valve body configured and disposed to open and close said effervescent liquid valving arrangement with movement of said actuator element. That valve body can be moved in a direction substantially perpendicular to a filling axis (FA) through said filling machine element.

For pressure filling, one embodiment of non-effervescent liquid beverage ducting arrangement is configured and disposed to serve as a return gas duct.

One embodiment of the liquid beverage container filling machine further comprises a container carrier; and an actuator device configured and disposed to raise and lower said container carrier against said beverage filling element. In that embodiment, the diverting element is connected to and rotatable with said container carrier.

One method for filling containers with effervescent and non-effervescent liquid beverages from such a beverage container filling machine comprises providing a reservoir arrangement configured to hold at least one of a non-effervescent liquid beverage and an effervescent liquid beverage with at least one filling element connected to said reservoir arrangement. With that configuration of filling element, the method comprises the steps of initiating the open-filling of containers with said non-effervescent liquid by: (i) activating said non-effervescent liquid valving arrangement of said non-effervescent liquid beverage duct to open access to said non-effervescent liquid beverage discharge opening; (ii) open-filling a plurality of containers with said non-effervescent liquid beverage; and (iii) stopping flow of said non-effervescent liquid into said non-effervescent liquid beverage duct by activating said non-effervescent liquid valving arrangement of said non-effervescent liquid beverage duct to close access to said non-effervescent liquid beverage discharge opening.

The aforementioned filling container method then further comprises the steps of initiating pressure-filling of containers with said effervescent liquid by: (i) activating said effervescent liquid valving arrangement of said effervescent liquid beverage duct to open access to said effervescent liquid beverage discharge opening; (ii) pressure-filling a plurality of containers with said effervescent liquid beverage; and (iii) stopping flow of said effervescent liquid into said liquid beverage duct by activating said effervescent liquid valving arrangement of said effervescent liquid beverage duct to close access to said effervescent liquid beverage discharge opening.

The present application is described above with reference to one possible embodiment, although it goes without saying that numerous modifications and variations can be made without thereby going beyond the scope of the teaching on which the present application is based.

The following patents, patent applications or patent publications, are hereby incorporated by reference as if set forth in their entirety herein: U.S. Pat. No. 6,860,414, published Mar. 1, 2005, having the English translation of title "FILLING HEAD;" US Published Application No. 2005/257499, published on Nov. 24, 2005, having the English translation of title "BEVERAGE BOTTLING PLANT FOR FILLING BOTTLES WITH A LIQUID BEVERAGE MATERIAL HAVING A FILLING MACHINE;". DE 10 2004 015 167 B3, published on Nov. 3, 2005, having the English translation of title "FILLING HEAD FOR COUNTER PRESSURE FILLING AND FREE JET FILLING;" DE 39 03 768 A1, published Jan. 3, 1990, having the English translation of title "METHOD FOR FILLING CONTAINERS, ESPECIALLY BOTTLES, WITH A LIQUID MATERIAL WHICH IS PREFERABLY UNDER AMBIENT PRESSURE AND A FILLING MACHINE FOR IMPLEMENTING THE METHOD;" U.S. Pat. No. 4,410,108, published Oct. 18, 1983, having the title "PRESSURE-ACTUATED VALVE FOR USE WITH POSITIVE DISPLACEMENT FILLING MACHINE;" and JP 2001-122394 A, published on May 8, 2001, having the English translation of title "NOZZLE CLEANING APPARATUS FOR ROTARY TYPE LIQUID CHARGING MACHINE."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

This present application relates to a filling element for a filling machine for the filling of bottles or similar containers with a liquid, with a liquid duct realized in a housing of the filling element and with a controllable liquid valve located in the liquid duct between a connection for the feed of the liquid being bottled and a discharge opening for the discharge of the liquid being bottled into a container.

One feature or aspect of an embodiment is believed at the time of the filing of this patent application to possibly reside broadly in a filling element for a filling machine for filling bottles or similar containers 2, 2*a* with a liquid to be bottled, with a liquid duct 8 realized in a housing 6 of the filling element 1 and with a controllable first liquid valve 23 located in the liquid duct 8 between a connection 9 for the delivery of the liquid to be bottled and at least a first discharge opening 22 for the discharge of the liquid into the containers 2, 2*a* to be filled, wherein in the housing 6 of the filling element 1, 1*a*, in addition to the liquid duct 8, an additional flow duct 7 is realized which can controlled by means of an additional liquid valve 15 and placed in communication with the connection 9 for the delivery of the liquid being bottled, and that the additional flow duct 7, in the vicinity of the first discharge opening 22, forms at least one additional discharge opening in which a gas shutoff valve 13.1 is provided.

Another feature or aspect of an embodiment is believed at the time of the filing of this patent application to possibly reside broadly in the filling element, wherein the at least one additional discharge opening is formed by a short filler tube 13.

Yet another feature or aspect of an embodiment is believed at the time of the filing of this patent application to possibly reside broadly in the filling element, wherein the at least one first discharge opening 22 is realized in the shape of a ring or a partial ring.

Still another feature or aspect of an embodiment is believed at the time of the filing of this patent application to possibly reside broadly in the filling element, wherein the at least one first discharge opening 22 surrounds the at least one additional discharge opening in the shape of at least a partial ring.

A further feature or aspect of an embodiment is believed at the time of the filing of this patent application to possibly reside broadly in the filling element, wherein the gas shutoff valve 13.1 is realized in the form of a screen and/or is formed by a plurality of ducts, each of which is open on both ends.

Another feature or aspect of an embodiment is believed at the time of the filing of this patent application to possibly reside broadly in the filling element, wherein the first liquid valve 23 has a valve body 24 which is provided or realized on a valve plunger 12 and can be moved to open and close this liquid valve by a valve stroke in an axial direction, for example in the direction of a vertical axis FA of the filling element, and that in the valve plunger 12, a plunger duct 12.1 is realized which forms at least a part of the additional flow path 7.

Yet another feature or aspect of an embodiment is believed at the time of the filing of this patent application to possibly reside broadly in the filling element, wherein at least one controllable gas duct 26, 27, with corresponding valves 26.1, 27.1, empties into the additional flow path 7.

Still another feature or aspect of an embodiment is believed at the time of the filing of this patent application to possibly reside broadly in the filling element, wherein the additional liquid valve 15 has a valve body 17 which can be moved in a reciprocating valve movement to open and close the liquid valve by means of an actuator element 16.

A further feature or aspect of an embodiment is believed at the time of the filing of this patent application to possibly reside broadly in the filling element, wherein the valve body 17 of the additional liquid valve 15 can be moved in an axial direction at a right angle or perpendicular or virtually perpendicular to the filling element axis FA.

Another feature or aspect of an embodiment is believed at the time of the filing of this patent application to possibly reside broadly in the filling element, wherein the additional filling valve 15 has a valve body 17 which can be moved by a valve stroke in a valve chamber 14 to open and close this liquid valve.

Yet another feature or aspect of an embodiment is believed at the time of the filing of this patent application to possibly reside broadly in the filling element, wherein the valve chamber 14 is part of the additional flow path 7.

Another feature or aspect of an embodiment is believed at the time of the filing of this patent application to possibly reside broadly in the filling element, wherein the plunger duct 12.1 empties into the valve chamber 14.

Yet another feature or aspect of an embodiment is believed at the time of the filing of this patent application to possibly reside broadly in the filling element, wherein the at least one controllable gas duct 26, 27 empties into the valve chamber 14.

Still another feature or aspect of an embodiment is believed at the time of the filing of this patent application to possibly reside broadly in the filling element, wherein for open-jet filling it can be controlled so that when the first liquid valve 23 is closed and the additional liquid valve 15 is open, the liquid being bottled flows to the individual container 2, 2*a* located under the filling element 1, 1*a* in the form of an open jet via the additional flow path 7 and the additional discharge opening provided with the gas shutoff valve 13.1.

A further feature or aspect of an embodiment is believed at the time of the filing of this patent application to possibly reside broadly in the filling element, wherein the filling element 1, 1*a* for pressure filling can be controlled so that the liquid being bottled, with the additional liquid valve 15 closed and the first liquid valve 23 opened, flows to the container 2, 2*a* which is in sealed contact against the filling element 1, 1*a* by means of the at least one first discharge opening 23, and the additional flow path 7 acts as the return gas duct.

Another feature or aspect of an embodiment is believed at the time of the filing of this patent application to possibly reside broadly in the filling element, wherein the filling element 1, 1*a* comprises a container carrier 4, 4*a* on the filling element 1, 1*a* and by an actuator device 30 for the raising and lowering of the container carrier 4, 4*a*.

Yet another feature or aspect of an embodiment is believed at the time of the filing of this patent application to possibly reside broadly in the filling element, wherein the container carrier 4 is realized for a suspended position of the individual container 2.

Still another feature or aspect of an embodiment is believed at the time of the filing of this patent application to possibly reside broadly in the filling element, wherein the container carrier 4*a* is realized for an upright orientation of the individual container 2*a*.

A further feature or aspect of an embodiment is believed at the time of the filing of this patent application to possibly reside broadly in the filling element, wherein a centering element 25 which surrounds the at least one first discharge opening 22, which centering element 25 can be closed by a closing element 34 for a CIP cleaning, and possibly for the formation of a rinsing chamber into which the at least one first discharge opening 22 as well as the at least one additional discharge opening having the gas shutoff valve 13.1 empty.

Another feature or aspect of an embodiment is believed at the time of the filing of this patent application to possibly reside broadly in the filling element, wherein the closing element 34 is provided or formed on the container carrier 4.

Another feature or aspect of an embodiment is believed at the time of the filing of this patent application to possibly reside broadly in the filling machine for the filling of containers 2, 2*a* with a liquid to be bottled, with at least one filling station formed by a filling element 1, 1*a* and a container carrier 4*a*, wherein the filling element 1, 1*a* is realized as the filling element 1, 1*a* of the present application.

Yet another feature or aspect of an embodiment is believed at the time of the filing of this patent application to possibly reside broadly in the filling machine, wherein the filling machine comprises a plurality of filling elements 1, 1*a* on a rotor 3 which can be driven in rotation around a vertical machine axis.

One feature or aspect of an embodiment is believed at the time of the filing of this patent application to possibly reside broadly in a filling element for a filling machine for filling bottles or similar containers 2, 2*a* with a liquid to be bottled, with a first liquid duct 8 realized in a housing 6 of the filling element 1, and with a controllable first liquid valve 23 located in the first liquid duct 8 between a connection 9 for the delivery of the liquid to be bottled and at least one first discharge opening 22 for the discharge of the liquid to be bottled into the containers 2, 2*a* to be filled, with a valve plunger 12 which is provided with a valve body 24 and can be moved by a reciprocating stroke for opening and closing, whereby in the housing 6 of the filling element 1, 1*a*, in addition to the first liquid duct 8, a second liquid duct 7 is realized, which can be connected in a controlled manner by means of a second liquid valve 15, with the connection 9 for the delivery of the liquid to be bottled and forms, in the vicinity of the first discharge opening 22, at least one additional discharge opening, whereby the valve plunger 12 of the first liquid valve 23 is provided with a plunger duct 12.1, which empties with one end into a chamber 14 realized above the valve plunger 12 in the housing 6 of the filling element, which chamber, together with the plunger duct 12.1 forms at least a part of the second liquid channel 7, and whereby the second liquid valve 15 has a valve body 17 which can be moved by a valve stroke for opening and closing by an actuator element 16 characterized in that, a gas shutoff valve 13.1 is provided in the additional discharge opening, and that the chamber 14 is a valve chamber in which the valve body 17 of the additional liquid valve 15 is located so that it can move by its valve stroke.

Another feature or aspect of an embodiment is believed at the time of the filing of this patent application to possibly reside broadly in the filling element, wherein the valve body 24 can be moved with the valve plunger 12 for the opening and closing of the first liquid valve 23 by a valve stroke in a vertical filling element axis FA.

Yet another feature or aspect of an embodiment is believed at the time of the filing of this patent application to possibly reside broadly in the filling element, wherein the valve body 17 of the additional liquid valve 15 can be moved in an axial direction at a right angle or perpendicular to the filling element axis FA.

One feature or aspect of an embodiment is believed at the time of the filing of this patent application to possibly reside broadly in a filling element for a filling machine for filling bottles or similar containers 2, 2*a* with a liquid to be bottled, with a first liquid duct 8 realized in a housing 6 of the filling element 1, and with a controllable first liquid valve 23 located in the first liquid duct 8 between a connection 9 for the delivery of the liquid to be bottled and at least one first discharge opening 22 for the discharge of the liquid to be bottled into the containers 2, 2*a* to be filled, with a valve plunger 12 which is provided with a valve body 24 and can be moved by a reciprocating stroke for opening and closing, whereby in the housing 6 of the filling element 1, 1*a*, in addition to the first liquid duct 8, a second liquid duct 7 is realized, which can be connected in a controlled manner by means of a second liquid valve 15, with the connection 9 for the delivery of the liquid to be bottled and forms, in the vicinity of the first discharge opening 22, at least one additional discharge opening, whereby the valve plunger 12 of the first liquid valve 23 is provided with a plunger duct 12.1, which empties with one end into a chamber 14 realized above the valve plunger 12 in the housing 6 of the filling element, which chamber, together with the plunger duct 12.1 forms at least a part of the second liquid channel 7, and whereby the second liquid valve 15 has a valve body 17 which can be moved by a valve stroke for opening and closing by an actuator element 16 characterized in that, a gas shutoff valve 13.1 is provided in the additional discharge opening.

One feature or aspect of an embodiment is believed at the time of the filing of this patent application to possibly reside broadly in a filling element for a filling machine for filling bottles or similar containers 2, 2*a* with a liquid to be bottled, with a first liquid duct 8 realized in a housing 6 of the filling element 1, and with a controllable first liquid valve 23 located in the first liquid duct 8 between a connection 9 for the delivery of the liquid to be bottled and at least one first discharge opening 22 for the discharge of the liquid to be bottled into the containers 2, 2*a* to be filled, with a valve plunger 12 which is provided with a valve body 24 and can be moved by a reciprocating stroke for opening and closing, whereby in the housing 6 of the filling element 1, 1*a*, in addition to the first liquid duct 8, a second liquid duct 7 is realized, which can be connected in a controlled manner by means of a second liquid valve 15, with the connection 9 for the delivery of the liquid to be bottled and forms, in the vicinity of the first discharge opening 22, at least one additional discharge opening, whereby the valve plunger 12 of the first liquid valve 23 is provided with a plunger duct 12.1, which empties with one end into a chamber 14 realized above the valve plunger 12 in the housing 6 of the filling element, which chamber, together with the plunger duct 12.1 forms at least a part of the second liquid channel 7, and whereby the second liquid valve 15 has a valve body 17 which can be moved by a valve stroke for opening and closing by an actuator element 16 wherein, a gas shutoff valve 13.1 is provided in the additional discharge opening.

Another feature or aspect of an embodiment is believed at the time of the filing of this patent application to possibly reside broadly in the filling element, wherein the first liquid valve 23 is realized for an opening by the filling pressure of the liquid being bottled acting on the valve plunger 12.

Yet another feature or aspect of an embodiment is believed at the time of the filing of this patent application to possibly reside broadly in the filling element, wherein the valve body 24 can be moved with the valve plunger 12 for the opening and closing of the first liquid valve 23 by a valve stroke in a vertical filling element axis FA.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Aug. 14, 2007, and/or cited elsewhere are hereby incorporated by reference as if set forth in their entirety herein as follows: US 2004/149784, published on Aug. 5, 2004, having the title "FILLING HEAD;" EP 1593648, published on Nov. 9, 2005, having the English translation of the title "FILLING VALVE WITH A GAS BARRIER HAVING A SWIRL EFFECT;" EP 0567913, published on Nov. 3, 1993, having the title "FILLING HEAD FOR BOTTLING MACHINES FOR FILLING BOTTLES OR SIMILAR CONTAINERS;" U.S. Pat. No. 6,375,050, published on Apr. 23, 2002, having the title "FILLING SPOUT WHOSE FLOW RATE CAN BE ADJUSTED BY A SINGLE ACTUATOR DEVICE;" and U.S. Pat. No. 5,193,593, published Mar. 16, 1993, having the title "PACKAGE FILLING METHOD AND APPARATUS."

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 017 706.1, filed on Apr. 15, 2006, having inventor Dieter-Rudolf KRULITSCH, and DE-OS 10 2006 017 706.1 and DE-PS 10 2006 017 706.1, and International Application No. PCT/EP2007/002998, filed on Apr. 3, 2007, having WIPO Publication No. WO 2007/118607 and inventor Dieter-Rudolf KRULITSCH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/002998 and German Patent Application 10 2006 017 706.1 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/002998 and German patent application 10 2006 017 706.1 from which this patent application claims priority which do not have to do with the correction of the translation in this patent application are not to be included in this patent application in the incorporation by reference.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

PARTIAL LIST OF NOMENCLATURE

1, 1*a* Filling element
2 Bottle
2.1 Bottle mouth
2.2 Bottle flange
2*a* Can
2*a*.1 Can edge
3 Rotor
4, 4*a* Container carrier
5 Jet of liquid being bottled
6 Housing
6.1 Housing underside
7, 8 Flow path
9 Connecting duct
10 Outer connection
11 Measurement device
12 Plunger
12.1 Plunger duct
13 Tube segment
13.1 Gas shutoff valve
14 Valve chamber
15 Liquid valve
16 Actuator element
17 Valve body
18 Valve seat
19 Housing segment
20 Ring-shaped membrane gasket
21 Radial gasket
22 Ring-shaped discharge opening
23 Liquid valve
24 Valve body
25 Centering element
25.1 Seal in the centering element 25
25*a*.1 Seal in the centering element 25
25*a*.1 Seal
26, 27 Gas duct
26.1, 27.1 Control valve
28 Rod
29 Spring
30 Actuator element
31 Wall
32 Space
33 Gasket
34 Closing or diverting element
35, 36 Recess
38*a,b,c* Reservoirs
39*a,b,c* Reservoir valves
40 Magnetic flow meter
A Adjustment of the container carrier 4
FA Vertical axis of the filling element

What is claimed is:

1. A container filling machine filling element configured to fill containers with a liquid, said filling element comprising:

a housing and a supply duct connected thereto to supply liquid into said housing;

a first liquid duct being disposed in said housing and comprising a first discharge opening;

a first liquid valve being disposed in said first liquid duct and being configured to control flow of liquid out of said first discharge opening;

a second liquid duct being disposed in said housing and comprising a second discharge opening;

a second liquid valve being configured to control flow of liquid from said supply duct through said second liquid duct; and a gas shutoff element being disposed in said second liquid duct and adjacent said first and second discharge openings.

2. The container filling machine filling element according to claim 1, wherein:

said first liquid valve comprises a valve plunger and a valve body disposed or formed thereon;

said valve plunger can be moved to open and close said first liquid valve by a valve stroke in an axial direction essentially along a vertical axis of said filling element; and said valve plunger comprises a plunger duct portion which forms at least a part of said second liquid duct.

3. The container filling machine filling element according to claim 2, wherein said second liquid valve comprises a second valve body operatively connected to an actuator element to move said second valve body in a reciprocating movement to open and close said second liquid valve.

4. The container filling machine filling element according to claim 3, wherein said second liquid duct comprises a valve chamber in which said second valve body is disposed.

5. The container filling machine filling element according to claim 4, wherein said plunger duct is connected to said valve chamber.

6. The container filling machine filling element according to claim 5, wherein said second discharge opening comprises a short filler tube.

7. The container filling machine filling element according to claim 6, wherein one of (A) and (B):

(A) said first discharge opening is in the shape of a ring or a partial ring; and (B) said first discharge opening surrounds said second discharge opening in the shape of at least a partial ring.

8. The container filling machine filling element according to claim 7, wherein said gas shutoff element comprises a screen and/or a plurality of ducts, and is open on both ends.

9. The container filling machine filling element according to claim 8, wherein said housing comprises at least one controllable gas duct connected to said second liquid duct.

10. The container filling machine filling element according to claim 9, wherein said valve body of said second liquid valve can be moved in an axial direction essential perpendicular to the filling element axis.

11. The container filling machine filling element according to claim 10, wherein said at least one controllable gas duct is connected to said valve chamber.

12. The container filling machine filling element according to claim 11, wherein for open-jet filling in which liquid flows from said filling element to a container disposed below and a distance from said filling element, said first liquid valve is closed and said second liquid valve is open to permit flow of liquid through said second liquid duct and said second discharge opening.

13. The container filling machine filling element according to claim 12, wherein for pressure filling in which liquid flows from said filling element to a container disposed below and in sealing engagement with said filling element, said second liquid valve is closed and said first liquid valve is opened to permit flow of liquid through said first liquid duct and said first discharge opening, and said liquid duct acts as a return gas duct.

14. The container filling machine filling element according to claim 13, wherein said container filling machine filling element comprises a container carrier and an actuator device configured to raise and lower said container carrier, which container carrier is configured to carry containers in a suspended position or an upright orientation.

15. The container filling machine filling element according to claim 14, wherein said container filling machine filling element comprises a centering element disposed to surround said first discharge opening, which centering element can be closed by a closing element for a CIP cleaning, and for the formation of a rinsing chamber into which said first discharge opening and said second discharge opening empty.

16. The container filling machine filling element according to claim 15, wherein said closing element is provided or formed on said container carrier.

17. The container filling machine filling element according to claim 1, in combination with a plurality of container filling machine filling elements, each having a corresponding container carrier and being disposed about a rotatable rotor of a container filling machine.

18. The container filling machine filling element according to claim 1, wherein said first discharge opening is configured to dispense liquid in a pressure filling operation upon said second liquid valve being closed, and said second discharge opening is configured to dispense liquid in an open-jet filling operation upon said first liquid valve being closed.

19. The container filling machine filling element according to claim 18, wherein said first discharge opening is configured to dispense effervescent liquid, and said second discharge opening is configured to dispense non-effervescent liquid.

20. The container filling machine filling element according to claim 1, wherein said first discharge opening is configured to dispense effervescent liquid, and said second discharge opening is configured to dispense non-effervescent liquid.

* * * * *